US006618913B2

(12) United States Patent
Notomi

(10) Patent No.: US 6,618,913 B2
(45) Date of Patent: Sep. 16, 2003

(54) DECORATIVE RIBBON FORMING DEVICE, AND DECORATIVE RIBBON FORMING AND MOUNTING DEVICE

(75) Inventor: Teruko Notomi, Fukuoka (JP)

(73) Assignee: Yugen Kaisha Ichiryu, Fukuoka (JP)

( * ) Notice: Subject to any disclaimer, the term of this patent is extended or adjusted under 35 U.S.C. 154(b) by 0 days.

(21) Appl. No.: 10/088,653

(22) PCT Filed: Apr. 9, 2001

(86) PCT No.: PCT/JP01/03053

§ 371 (c)(1),
(2), (4) Date: Apr. 15, 2002

(87) PCT Pub. No.: WO01/77430

PCT Pub. Date: Oct. 18, 2001

(65) Prior Publication Data

US 2002/0162199 A1 Nov. 7, 2002

(30) Foreign Application Priority Data

Apr. 12, 2000 (JP) ..... 2000-110911

(51) Int. Cl.[7] ..... A44B 1/38; D04D 7/04; A41G 1/02; B65D 63/00

(52) U.S. Cl. ..... 24/581.1; 24/16 PB; 24/17 B; 24/324; 24/350; 24/716; 206/449

(58) Field of Search ..... 24/581.1, 5, 6, 24/3.12, 3.13, 17 B, 324, 581.11, 706.1, 716; 16/87.2; 248/71; 206/449

(56) References Cited

U.S. PATENT DOCUMENTS 1,480,009 A * 1/1924 Preston ..... 24/350
2,937,834 A * 5/1960 Orenick et al. ..... 248/71
3,161,929 A * 12/1964 Swett ..... 24/178
3,561,074 A * 2/1971 Mosher, Jr. et al. ..... 24/324
4,010,503 A * 3/1977 Denton ..... 24/16 PB
4,566,592 A * 1/1986 Klukos ..... 206/449
4,962,573 A * 10/1990 Breveglieri ..... 24/581.1
5,339,884 A * 8/1994 Angerman ..... 24/716
6,044,528 A * 4/2000 Schottin ..... 24/265 AL

FOREIGN PATENT DOCUMENTS

| | | |
|---|---|---|
| JP | 62110291 | 7/1987 |
| JP | 63164461 | 10/1988 |
| JP | 63175188 | 11/1988 |

* cited by examiner

*Primary Examiner*—Victor Sakran
(74) *Attorney, Agent, or Firm*—Jordan and Hamburg LLP

(57) ABSTRACT

A ribbon-decoration forming tool for binding a decorative ribbon strip, which defines a plurality of loops, to form a ribbon-decoration, said ribbon-decoration forming tool including: a first flat plate provided with an engagement member, the engagement member having an enlarged portion at the outer end thereof; a second flat plate having a holding portion for holding the engagement member which allows said enlarged portion to protrude outside therefrom; a connecting member connecting said first flat plate and said second flat plate; and a binding portion for binding a ribbon strip to form a ribbon-decoration, wherein the binding portion is defined by the first and second flat plates associated with each other in the relationship such that the enlarged portion protrudes outside from the holding portion, said connecting member and said engagement member.

4 Claims, 5 Drawing Sheets

(a)

(b)

(c)

(a)

(b)

(c)

DECORATIVE RIBBON FORMING DEVICE, AND DECORATIVE RIBBON FORMING AND MOUNTING DEVICE

TECHNICAL FIELD

The present invention relates to a ribbon-decoration forming tool and a ribbon-decoration forming/attaching assembly using the tool, capable of forming a ribbon-decoration, such as decorative bow, from a ribbon strip, and readily attaching the formed ribbon-decoration to an object, such as a gift box or a gift or shopping bag.

BACKGROUND ART

There are a number of occasions of presenting a gift on happy events, such as wedding, birth, wedding anniversary, graduation and entrance, or seasonal events, such as Valentine day, White day and Christmas. Traditionally, on the occasion of presenting a gift even if it were handmade or purchased goods, the gift is wrapped in a fancy paper and decorated with a ribbon to make it a thoughtful present. In particular, a ribbon-decoration is an indispensable accessory of packaging.

A ribbon-decoration, such as a decorative bow or double bow, has been typically formed by knotting both ends of a single ribbon strip after binding a box with the ribbon strip in the form of a diagonal, crisscross or wedge pattern.

Further, Japanese Utility Model Publication No. 63-175188 describes to attach a pre-formed ribbon decoration to a mounting board.

For tying a ribbon strip to provide a ribbon-decoration with well-looking appearance, a certain level of skill is required. It also takes a relatively long time to prepare the ribbon-decoration, resulting in increased waiting time of customers. Further, when it is necessary to prepare a number of ribbon-decorations in a short period, for example, on Valentine day, White day or the like, bags of time are required. Besides, any packages each wrapped with a ribbon-decoration can be neither stocked in superimposed manner nor sent with putting them superimposedly in a carton box because the superimposition of such packages causes deformation or squash of the ribbon-decoration or ribbon flower. Consequently, the ribbon-decoration has been mostly prepared in conjunction with sales activity, resulting in the same problem as described above.

In the above publication, the type of available ribbon flowers is limited, and thereby it is difficult to provide desirable coordination with various decorative ribbon strips bound around a box or the like. The mounting board also needs to have adhesive layers and releasing sheets. This inevitably causes increased cost, and the attachment with adhesive involves the possibility of falling off.

DISCLOSURE OF INVENTION

It is an object of the present invention to provide a ribbon-decoration forming tool capable of forming a ribbon-decoration without spending time and effort, and facilitating an attaching operation of the formed ribbon-decoration.

The present invention provided a ribbon-decoration forming tool for binding a decorative ribbon strip, which defines a plurality of loops, to form a ribbon-decoration. The ribbon-decoration forming tool comprises a first flat plate provided with an engagement member having an enlarged portion at the outer end thereof, a second flat plate having a holding portion for holding the engagement member with allowing the enlarged portion to protrude outside therefrom, a connecting member connecting the first flat plate and the second flat plate, and a binding portion for binding a ribbon strip to form a ribbon-decoration. The binding portion is defined by the first and second flat plates associated with each other in the relationship such that the enlarged portion protrudes outside from the holding portion, the connecting member and the engagement member.

The engagement member may be an engagement rod formed with the enlarged portion at the outer end thereof, and the holding portion of the second flat plate may be a through hole allowing the enlarged portion to be passed therethrough.

Further, according to the present invention, there is provided a ribbon-decoration forming/attaching assembly comprising the aforementioned ribbon-decoration forming tool, and a ribbon-decoration attaching tool for attaching the formed ribbon-decoration to an object. The ribbon-decoration attaching tool includes a holding portion for holding the enlarged portion which protrudes from the second flat plate of the ribbon-decoration forming tool.

The ribbon-decoration attaching tool may include an attaching portion adapted to be attached to an object. Further, the holding portion of the ribbon-decoration attaching tool may be a through hole, and the attaching portion may be an attaching hole having a notch.

BEST MODE FOR CARRYING OUT THE INVENTION

The present invention is directed to a ribbon-decoration forming tool 1 for forming a ribbon-decoration, or a ribbon-decoration forming/attaching assembly comprised of the ribbon-decoration forming tool 1 and a ribbon-decoration attaching tool 2 for attaching the formed ribbon-decoration to a decorative ribbon strip, a shopping bag or the like. Preferably, the ribbon-decoration forming tool 1 and the ribbon-decoration attaching tool 2 are made of a material having flexibility, for example synthetic resin such as vinyl chloride resin.

Figure 1:
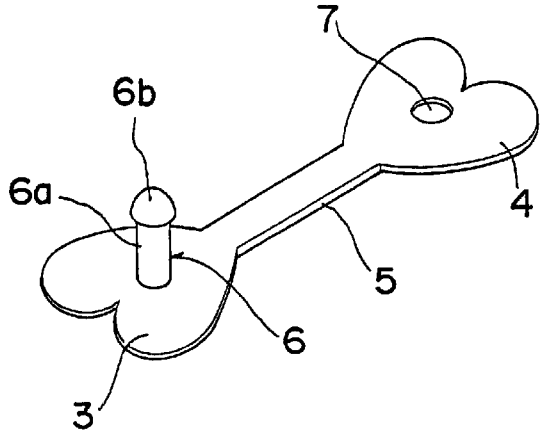
FIG. 1 is a perspective view of a ribbon-decoration forming tool in a ribbon-decoration forming/attaching assembly of the present invention.

In FIG. 1, the ribbon-decoration forming tool 1 comprises a first flat plate 3, a second flat plate 4, and a connecting member 5 connecting the first flat plate 3 and the second flat plate 4. The first flat plate 3 is provided with an engagement member 6. For example, the engagement member 6 may include an engagement pole or pillar 6*a* and a conical enlarged portion 6*b* provided at the outer end of the engagement pole 6*a*. The enlarged portion 6*b* has an inner or engagement-pole-side edge having a larger diameter than that of the engagement pole 6*a*.

An artificial flower or a stick-on label printed thereon a logo or characters representing Valentine day, White day or the like may be adhesively attached on the surface of the first flat plate 3. The first flat plate 3 may also be formed in various shapes, such as a heart shape or a logo shape. Further, various ribbon-decoration forming tools 1 each having a different color may be prepared to provide desirable color coordination with a ribbon-decoration to be attached to each of the ribbon-decoration forming tools.

The second flat plate 4 is formed with a through hole 7 serving as a holding portion for holding the engagement member 6. The enlarged portion 6*b* of the engagement member 6 is configured to allow the engagement member 6 to be held by the edge of the through hole 7 in the state after the enlarged portion 6*b* is forcedly passed through the through hole 7. The engagement member 6 or the enlarged portion 6*b* can also be drawn out of the through hole 7 because the ribbon-decoration forming tool 1 is made of a material having a suitable flexibility.

Figure 2:
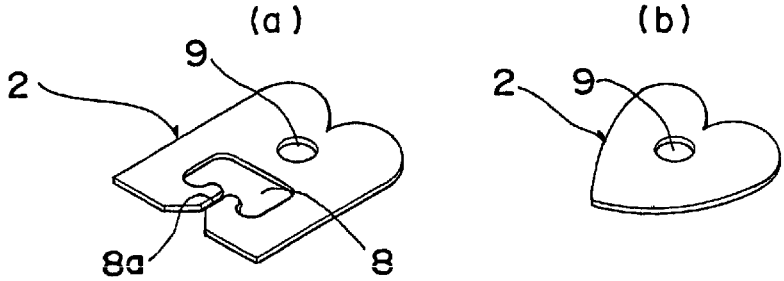
FIG. 2 is a perspective view of a ribbon-decoration attaching tool in a ribbon-decoration forming/attaching assembly of the present invention.

In FIG. 2(*a*), the ribbon-decoration attaching tool 2 is formed with an attaching hole 8 serving as an attaching portion adapted to be attached to an object, such as a decorative ribbon strip, string or tape. The attaching hole 8 includes a notch 8*a* allowing a decorative ribbon strip, string or tape to be passed therethrough. The ribbon-decoration attaching tool 2 is also formed with a through hole 9 serving as a holding portion for allowing the enlarged portion 6*b* protruding from the through hole 7 of the second flat plate 4 to be forcedly passed therethrough to hold the engagement member 6.

When a ribbon-decoration is attached to a greeting card or a shopping bag by use of a hole provided therein, the attaching hole for a decorative ribbon strip is unnecessary. In this case, the ribbon-decoration attaching tool 2 may be formed with only the through hole 9, as shown in FIG. 2(*b*). Further, the ribbon-decoration attaching tool 2 may be formed in a hart shape, a logo shape or the like to enhance appearance.

Figure 3:
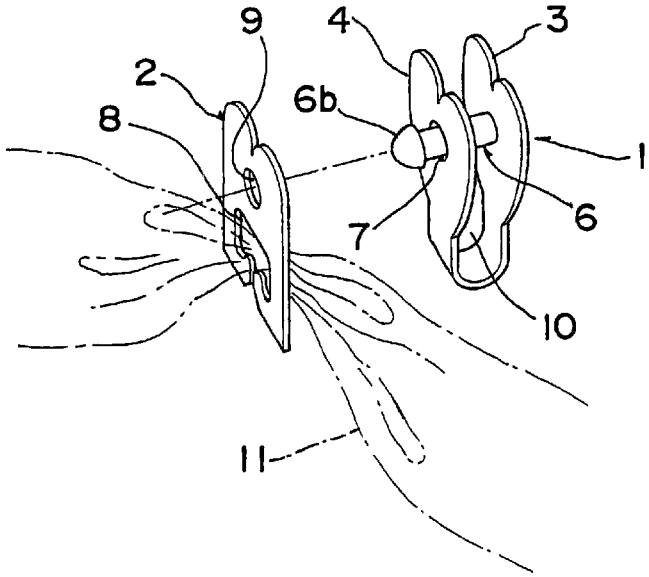
FIG. 3 illustrates the relationship between a ribbon-decoration forming tool and a ribbon-decoration attaching tool in a ribbon-decoration forming/attaching assembly of the present invention.

In the state as shown in FIG. 3, a ribbon-decoration (not shown) is formed through the steps of pressing and cramping a decorative ribbon strip by a ribbon binding portion 10 which is defined by the first flat plate 3, the second flat plate 4, the connecting member 5 and the engagement member 6 of the ribbon-decoration forming tool 1, and passing the enlarged portion 6*b* of the engagement member 6 through the through hole 7 of the second flat plate 4 to allow the enlarged portion 6*b* to be held by the edge of through hole 7.

Then, the enlarged portion 6*b* of the engagement member 6 of the ribbon-decoration forming tool 1 is passed through the through hole 9 of the ribbon-decoration attaching tool 2 attached to a decorative ribbon strip 11 through the attaching hole 8 to allow the enlarged portion 6*b* to be held by the edge of the through hole 9, so that the formed ribbon-decoration 1 associated with the ribbon-decoration tool 1 is attached to the decorative ribbon strip 11.

In this embodiment, the ribbon-decoration is a decorative bow. However, the present invention is not limited to this embodiment, and any other desired ribbon-decoration, such as a double bow or a fancy ribbon-decoration having a plurality of loops may be prepared by forming and binding two or more of loops.

Various applications of the ribbon-decoration forming/attaching assembly will be described below.

FIRST EMBODIMENT

Figure 4:
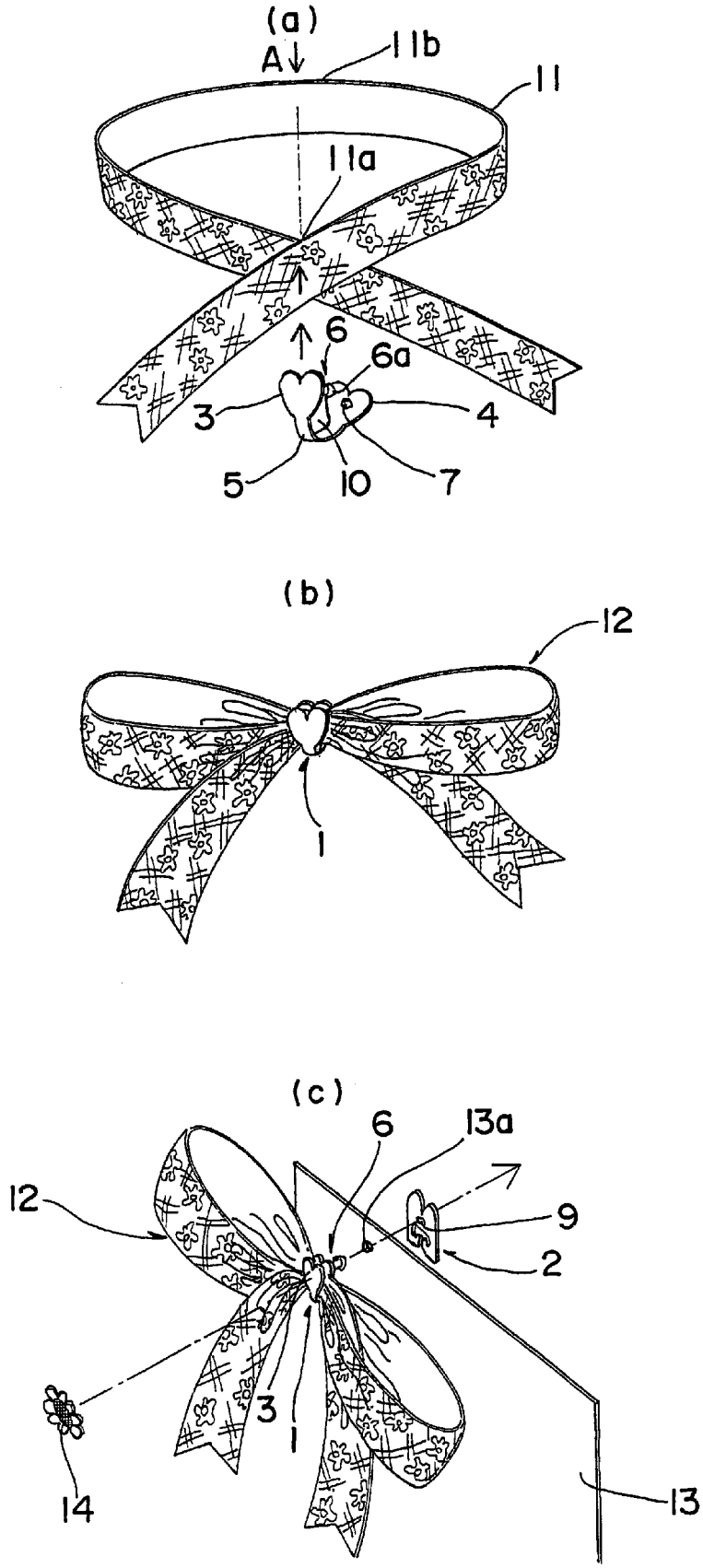
FIG. 4 illustrates a procedure of forming a ribbon-decoration and attaching the formed ribbon-decoration.

As shown in FIG. 4(*a*), just like the method for tying a ribbon, a decorative ribbon strip 11 is first crossed. Then, the crossed portion 11*a* and the middle portion 11*b* of the ribbon strip are gathered together by moving the middle portion in the direction of the arrow A, and the crossed portion 11*a* and the middle portion 11*b* are pressed. The pressed portions are clamped or bound by the binding portion 10 defined by the first flat plate 3, the second flat plate 4, the connecting member 5 and the engagement member 6 of the ribbon-decoration forming tool 1, and then the enlarged portion 6*b* of the engagement member 6 is passed through the through hole 7 of the second flat plate 4 to allow the enlarged portion 6*b* to be held by the edge of the through hole 7. Through the above operations, a ribbon decoration 12 is formed as shown in FIG. 4(*b*). Even if the ribbon-decoration 12 is formed by using a decorative ribbon strip in which an artistic pattern is printed on only the outer surface thereof, only the pattern can be brought into view to provide well-looking finishing and enhanced appearance.

As shown in FIG. 4(*c*), the enlarged portion 6*b* of the engagement member 6 protruding from the second flat plate 4 is passed through a hole 13*a* provided, for example, in a greeting card 13 to hold the ribbon-decoration 12. In this case, the ribbon-decoration attaching tool 2 having only the through hole 9 as shown in FIG. 2(*b*) may be used. For example, an artificial flower 14 may be adhesively attached on the surface of the first flat plate 3 associated with the ribbon-decoration 12 to enhance appearance.

SECOND EMBODIMENT

Figure 5:
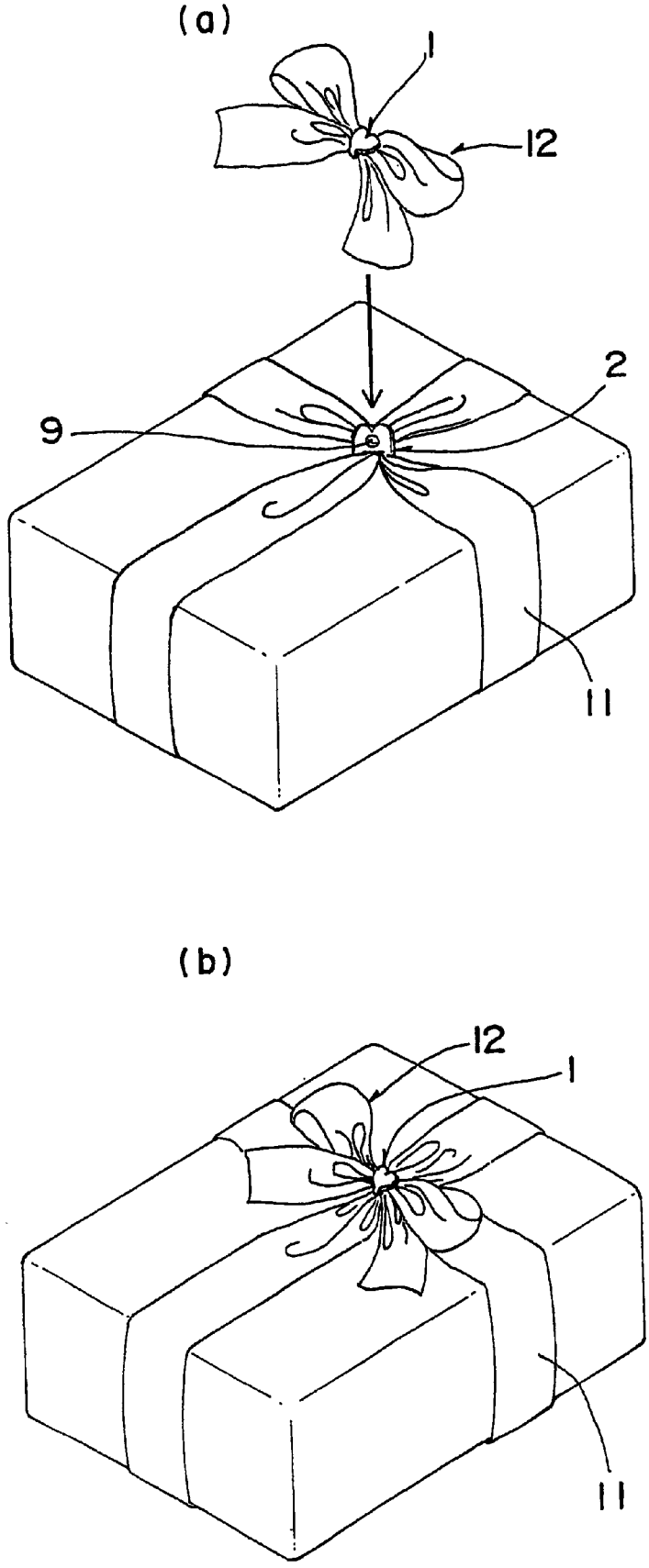
FIG. 5 illustrates a procedure of attaching a formed ribbon-decoration to a ribbon strip bound around a box in the form of a crisscross pattern.

As shown in FIG. 5(*a*), the ribbon-decoration attaching tool 2 is attached to a decorative ribbon strip 11 bound around a box in the form of a crisscross pattern by entering the decorative ribbon strip 11 into the attaching hole 8 through the notch 8*a* of the ribbon-decoration attaching tool 2. Then, as shown in FIG. 5(*b*), the ribbon-decoration 12 formed in the ribbon-decoration forming tool 1 as shown in FIG. 1 is attached to the decorative ribbon strip 11 by passing the enlarged portion 6*b* of the engagement member 6 of the ribbon-decoration forming tool 1 through the through hole 9 of the ribbon-decoration attaching tool 2. The ends of the decorative ribbon strip 11 bound around the box in the form of a crisscross pattern can be fixed to the bottom surface of the box with an adhesive tape without tying each other. This makes it possible to save on the decorative ribbon strip as competed to the case of forming a ribbon-decoration by tying the ends of the decorative ribbon strip.

For example, the first flat plate 3 of the ribbon-decoration forming tool 1 may have a heart shape or a heart-shaped label attached thereon for a gift of Valentine day, as shown in FIG. 5, to provide a package suitable for Valentine day.

THIRD EMBODIMENT

Figure 6:
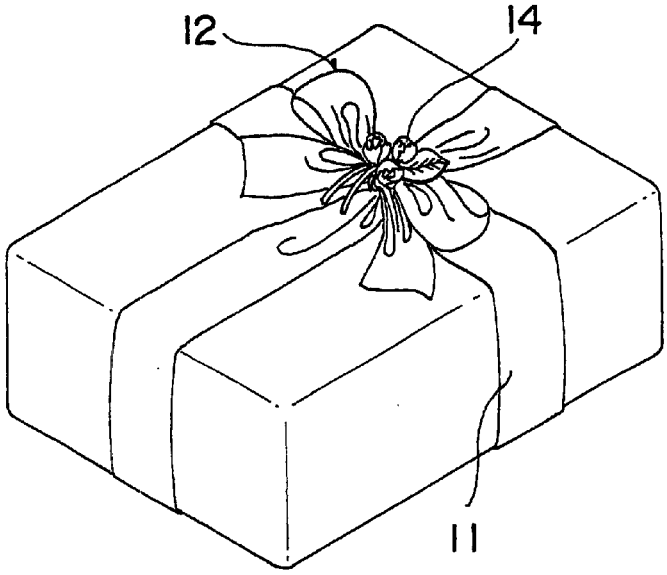
FIG. 6 illustrates various modes of attaching a ribbon-decoration.
Figure 6:
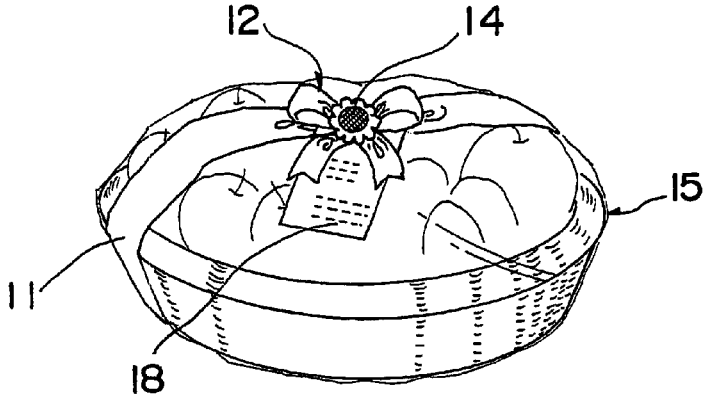
Figure 6:
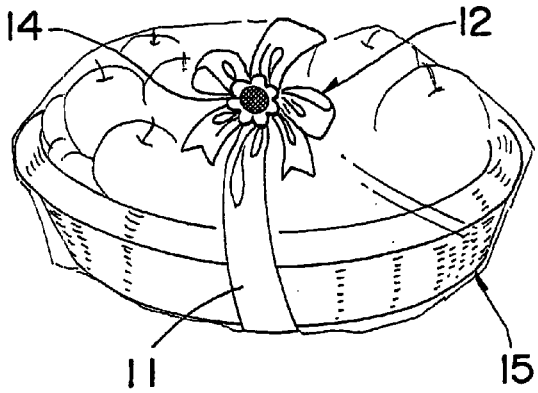

In FIG. 6(*a*), the ribbon-decoration 12 is attached to the decorative ribbon strip in the same manner as the second embodiment, and wires of the artificial flower 14 may be additionally clamped or bound together with the ribbon-decoration by the binding portion defining in the ribbon-decoration tool to enhance appearance.

In FIG. 6(*b*), a decorative ribbon strip 11 is bound around a fruit basket 15, and both the decorative ribbon strip 11 and the ribbon-decoration 12 are cramped or bound by the binding portion defining in the ribbon-decoration tool 1 to attach the ribbon decoration 12 to the decorative ribbon strip with orienting the ribbon decoration 12 in the same direction as that of the decorative ribbon strip. Further, the engagement member is passed through a hole provided in a message card 18 and then passed through the through hole of the ribbon-decoration attaching tool to sandwich the massage card between the second flat plate and the ribbon-decoration attaching tool.

In FIG. 6(*c*), as described in the second embodiment, after attaching the ribbon-decoration attaching tool to a decorative ribbon strip 11, the ribbon-decoration forming tool 1 with the ribbon-decoration 12 is attached to the ribbon-decoration attaching tool with orienting the loops of the ribbon-decoration 12 at right angles to the decorative ribbon strip 11. As with the aforementioned embodiments, the artificial flower may be attached to the first flat plate of the ribbon-decoration forming tool with the ribbon-decoration 12.

In FIGS. 6(*a*) to 6(*c*), the ends of the decorative ribbon may be fixed to the bottom surface of the box or basket by an adhesive tape to save on the decorative ribbon strip.

FOURTH EMBODIMENT

Figure 7:
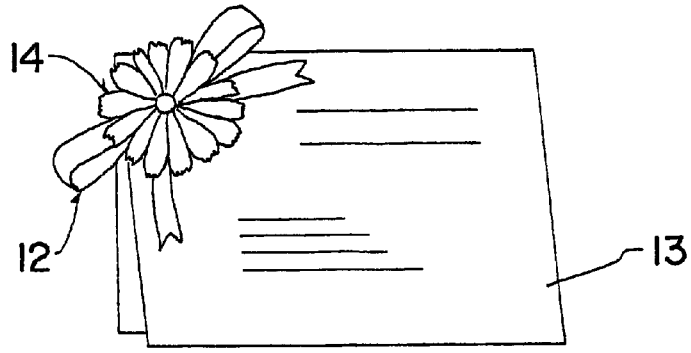
FIG. 7 illustrates various modes of attaching a ribbon-decoration.
Figure 7:
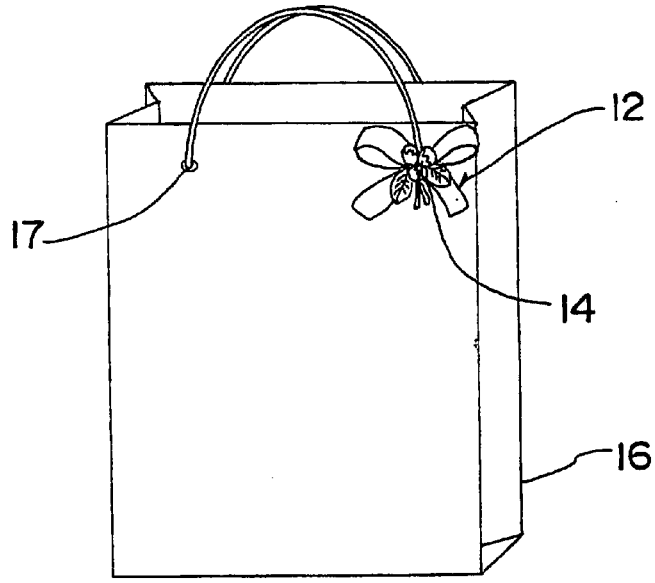
Figure 7:
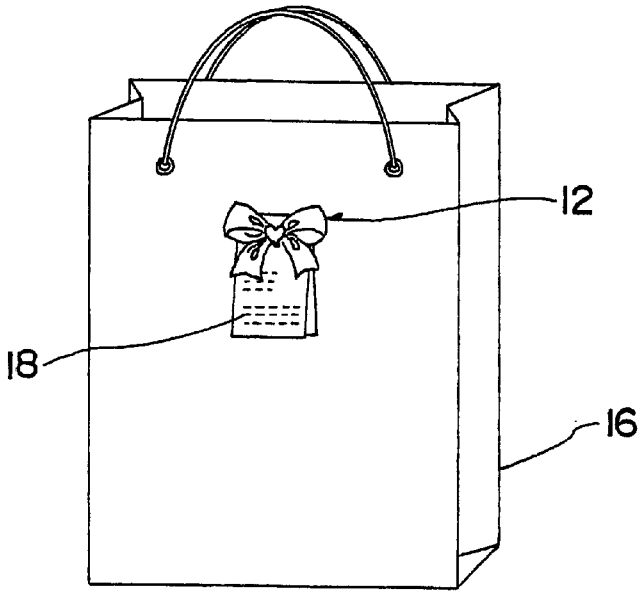

FIG. 7(*a*) shows an example in which the ribbon-decoration 12 is attached to a greeting card 13. In this example, a large artificial flower 14 is attached to the first flat plate of the ribbon-decoration forming tool with the ribbon-decoration 12. The ribbon-decoration 12 is attached in the same manner as that described in the first embodiment.

In FIG. 7(*b*), the enlarged portion 6*b* of the engagement member 6 protruding from the second flat plate 4 of the ribbon-decoration forming tool 1 as shown in FIG. 1 is passed through one of holes 17 for putting a cord of a shopping bag 16 therethrough, and is held on the backside of the shopping bag 16 by the ribbon-decoration attaching tool 2. The shopping bag with the ribbon-decoration attached thereon can give a favorable impression on customers.

In FIG. 7(*c*), a shopping bag 16 is provided with an additional hole. Then, the ribbon-decoration 12 is attached in the same manner as that of FIG. 7(*b*), and a logo tag or message card 18 is further sandwiched between the second flat plate and the ribbon-decoration attaching tool. During a special event such as Christmas season, a doll of Santa Claus or any other character doll may be hooked with the message card 18 or by itself.

The effects of the present invention are as follows.

(1) A ribbon-decoration can be quickly formed by using the ribbon-decoration forming tool, and can be readily attached to an object by using the ribbon-decoration attaching tool. Thus, customers will be free from boresome waiting time. Further, the ribbon-decoration can be formed only by fastening a partially pressed decorative ribbon strip by the ribbon-decoration forming tool. This makes it possible to form a no skill ribbon-decoration having a uniform facon. Further, only the surface of the ribbon-decoration having printed artistic patters can be brought into view to provide enhanced appearance.

(2) In order to provide desirable coordination with the ribbon-decoration, various artificial flowers or stick-on labels printed thereon a logo or characters representing Valentine day, White day or the like can be adhesively attached on the surface of the first flat plate. Further, the first flat plate can be formed in various shapes, such as a heart shape or logo shape, or the ribbon-decoration forming tools can be variously colored.

(3) Even if a number of ribbon-decorations are necessary for chocolate boxes in, such as Valentine day, the operation of forming ribbon-decorations can be performed separately from the operation of attaching the formed ribbon-decorations to the boxes. This provides enhanced operating efficiency. On the other hand, it is often the case that a ribbon-decoration is attached to a gift-chocolate box. In this case, the ribbon-decoration can be separately from the gift-chocolate box and packed them individually. This can prevent the ribbon-decoration from being deformed or squashed.

(4) Only a ribbon-decoration can be attached to a gift box without binding any decorative ribbon strip around the box, and thereby the decorative ribbon strip can be saved.

(5) A cordial personalized gift-wrapping can be created by selecting the patterns of decorative ribbon strips to be formed in the ribbon decoration, or labels or artificial flowers to be attached to the first flat plate of the ribbon-decoration forming tool, or by adding a message card or logo tag.

In view of the above effects (1) to (5), the present invention can be widely used in sales floors in gift shops or department stores, and any other marketplaces handling gift articles, such as chocolate, sweet stuffs or fruits.

What is claimed is:

1. A ribbon-decoration forming/attaching assembly comprising:

a ribbon-decoration forming tool for binding a decorative ribbon strip, which defines a plurality of loops, to form a ribbon-decoration, said ribbon-decoration forming tool including:

a first flat plate provided with an engagement member, said engagement member having an enlarged portion at the outer end thereof;

a second flat plate having a holding portion for holding said engagement member which allows said enlarged portion to protrude outside therefrom;

a connecting member connecting said first flat plate and said second flat plate; and a binding portion for binding a ribbon strip to form a ribbon-decoration, wherein said binding portion is defined by said first and second flat plates associated with each other in the relationship such that said enlarged portion protrudes outside from said holding portion, said connecting member and said engagement member; and a ribbon-decoration attaching tool for attaching said formed ribbon-decoration to an object, said ribbon-decoration attaching tool including a holding portion for holding said enlarged portion which protrudes from said second flat plate of said ribbon-decoration forming tool.

2. A ribbon-decoration forming/attaching assembly as defined in claim 1, wherein said ribbon-decoration attaching tool includes an attaching portion adapted to be attached to an object.

3. A ribbon-decoration forming/attaching assembly as defined in claim 2, said holding portion of said ribbon-decoration attaching tool is a through hole, and said attaching portion is an attaching hole having a notch.

4. A ribbon-decoration forming/attaching assembly comprising:

a ribbon-decoration forming tool for binding a decorative strip, which defines a plurality of loops, to form a ribbon-decoration, said ribbon-decoration forming tool including:

a first flat plate provided with an engagement member, said engagement member having an enlarged portion at the outer end thereof;

a second flat plate having a holding portion for holding said engagement member which allows said enlarged portion to protrude outside therefrom;

a connecting member connecting said first flat plate and said second flat plate;

a binding portion for binding a ribbon strip to form a ribbon-decoration, wherein said binding portion is defined by said first and second flat plates associated with each other in the relationship such that said enlarged portion protrudes outside from said holding portion, said connecting member being an engagement member; and said engagement member being an engagement rod formed with said enlarged portion at the outer end thereof, and said holding portion of said second flat plate being a through hole allowing said enlarged portion to be passed therethrough; and a ribbon-decoration attaching tool for attaching said formed ribbon-decoration to an object, said ribbon-decoration attaching tool including a holding portion for holding said enlarged portion which protrudes from said second flat plate of said ribbon-decoration forming tool.

* * * * *